US010827848B1

(12) United States Patent
Gluck

(10) Patent No.: US 10,827,848 B1
(45) Date of Patent: Nov. 10, 2020

(54) MATTRESS SPACER SYSTEM AND METHODS OF USING THE SAME

(71) Applicant: Adrian Gluck, Los Angeles, CA (US)

(72) Inventor: Adrian Gluck, Los Angeles, CA (US)

(73) Assignee: Instant Tuck IP Licensing, LLC, Los Angeles, CA (US)

( * ) Notice: Subject to any disclaimer, the term of this patent is extended or adjusted under 35 U.S.C. 154(b) by 0 days.

(21) Appl. No.: 16/517,647

(22) Filed: Jul. 21, 2019

Related U.S. Application Data

(60) Provisional application No. 62/864,536, filed on Jun. 21, 2019.

(51) Int. Cl.
*A47C 21/06* (2006.01)
*A47C 21/00* (2006.01)
*A47C 21/02* (2006.01)

(52) U.S. Cl.
CPC ..... *A47C 21/06* (2013.01); *A47C 21/00* (2013.01); *A47C 21/022* (2013.01); *A47C 21/026* (2013.01); *A47C 21/028* (2013.01)

(58) Field of Classification Search
CPC ..... A47C 21/028; A47C 21/06; A47C 21/00; A47C 21/022; A47C 21/026
See application file for complete search history.

(56) References Cited

U.S. PATENT DOCUMENTS 2,847,685 A 8/1958 Freedlander
2,940,087 A * 6/1960 Kiefer ..... A47C 27/04 5/642
3,728,747 A 4/1973 Docker
3,751,742 A * 8/1973 Worley ..... A47C 19/027 5/659
3,806,968 A * 4/1974 Robey ..... A47C 20/027 5/660
4,369,535 A 1/1983 Ekkerink
4,525,886 A * 7/1985 Savenije ..... A47C 31/123 5/236.1
4,649,583 A * 3/1987 Krueger, Sr. ..... A47C 21/06 5/659
4,712,261 A 12/1987 Castro
4,745,645 A * 5/1988 McWilliams ..... A47C 21/06 5/659
4,860,396 A * 8/1989 Vogel, II ..... A47C 19/027 5/659

(Continued)

*Primary Examiner* — Nicholas F Polito
*Assistant Examiner* — Morgan J McClure
(74) *Attorney, Agent, or Firm* — Barlow, Josephs & Holmes, Ltd.

(57) ABSTRACT

A passive mattress spacer pad provides an intermediate layer of material which sits between the bottom of the mattress and the underlying mattress support. In some embodiments, the spacer may have peripheral length and width dimensions that are roughly between about 1 and 18 inches smaller than the size of the mattress and have a thickness of between about ¼ inch and about 4 inches. In some embodiments, the spacer pad is independent, and in others, it is integrally formed with the support or the mattress. The spacer provides a measure of lift or elevation to the center of the mattress while leaving some space or "gap" around the peripheral edges where it is easier for the bed maker to slide their hands and the bed linens beneath the mattress edge without having to lift the mattress entirely.

11 Claims, 8 Drawing Sheets

(56) References Cited

U.S. PATENT DOCUMENTS 4,965,897 A * 10/1990 Taylor ..... A47C 20/00 5/643
5,926,874 A * 7/1999 Browder ..... A47C 21/028 5/482
6,871,369 B1 * 3/2005 Long ..... A47C 21/06 5/655.9
6,886,203 B2 * 5/2005 Drakos ..... A47C 21/028 5/488
D701,400 S * 3/2014 Gregory ..... D6/606
9,021,630 B2 * 5/2015 Scarleski ..... A47C 21/00 5/488
9,138,065 B2 * 9/2015 Chandler ..... A47C 27/148
9,907,406 B1 * 3/2018 McGrath ..... A47C 31/008
10,104,979 B2 10/2018 Bethel et al.
10,123,630 B2 * 11/2018 Scarleski ..... A47C 21/00
10,327,562 B2 * 6/2019 Scarleski ..... A47C 21/00
2002/0095729 A1 * 7/2002 Waters ..... A47C 21/00 5/504.1
2003/0101515 A1 * 6/2003 Gordon ..... A47C 21/06 5/659
2004/0133978 A1 * 7/2004 Fairchild ..... A47C 21/028 5/488
2005/0172412 A1 * 8/2005 Pearson ..... A47C 21/06 5/659
2006/0117486 A1 * 6/2006 Clark ..... A47C 21/06 5/659
2006/0230539 A1 * 10/2006 Goodman ..... A47C 19/045 5/660
2007/0000060 A1 * 1/2007 Firestone ..... A47C 21/06 5/659
2009/0083909 A1 * 4/2009 Amsler, Jr. ..... A47C 19/045 5/660
2009/0144905 A1 * 6/2009 Javaruski ..... A47C 21/06 5/630
2012/0260432 A1 * 10/2012 Scarleski ..... A47C 21/00 5/737
2013/0232698 A1 * 9/2013 Ward ..... A47C 21/028 5/659
2014/0026318 A1 * 1/2014 Bethel ..... A47C 21/028 5/412
2015/0096120 A1 * 4/2015 Scarleski ..... A47C 31/105 5/484
2015/0257542 A1 * 9/2015 Molina ..... A47C 21/06 141/4
2015/0342359 A1 * 12/2015 Molina ..... A47C 21/028 5/659
2015/0374134 A1 * 12/2015 Bethel ..... A47C 21/028 5/412
2017/0049242 A1 * 2/2017 Franken ..... A47C 21/06
2019/0029437 A1 * 1/2019 Sokvitne ..... A47C 21/00

* cited by examiner

MATTRESS SPACER SYSTEM AND METHODS OF USING THE SAME

CROSS-REFERENCE TO RELATED APPLICATIONS

This application claims the benefit of U.S. Provisional Application No. 62/864,536, filed Jun. 21, 2019, the entire contents of which is incorporated herein by reference.

BACKGROUND OF THE INVENTION

Homemakers must regularly change the sheets and linens on the beds in their homes. This is a strenuous task that necessarily involves repetitive lifting of, and manipulating a heavy, bulky mattress during the bed making process. Many homemakers, both young and old, find that lifting a heavy mattress while also trying to tuck bed linens beneath the mattress is next to impossible unless they have help. Even with two persons working together, making a bed can be a strenuous task.

Likewise, housekeepers at hotels, motels and inns must routinely change the linens on many beds every day. The stress and strain associated with the repetitive lifting of heavy mattresses during the bed making process eventually takes a toll on the worker in the form of fatigue, back and shoulder injuries, work loss, and on commercial establishments in terms of worker's compensation insurance claims.

Various improvements have been attempted, but all involve some type of active mechanical lifting apparatus which requires extra equipment or significant cost. For example, mechanical screw driven lifts within the box spring have been devised as well as numerous configurations of inflatable bladders. None have proven satisfactory in the mass market.

SUMMARY OF THE INVENTION

It would be advantageous if the bedding system itself, i.e. the platform or box spring and/or the mattress, could be designed to provide some measure of leverage for lifting of the mattress during the bed making process and thereby eliminate the need for homemakers and hotel or motel housekeepers to physically lift the mattress during the bed making process. Such a design would enable a single person to do the job by herself/himself and without the need for an assistant.

In a most basic description, the invention comprises a passive "spacer" or intermediate layer of material which is positioned between the bottom of the mattress and the underlying support, such as a box spring, slats, platform etc. In some embodiments, the spacer may have peripheral length and width dimensions that are roughly between about 1 and 18 inches smaller than the size of the mattress and may be positioned centrally beneath the mattress. The spacer may have a thickness of between about ¼ inch and about 4 inches. In these embodiments, the spacer is a generally rectangular shaped pad which is slightly smaller in dimensions than the mattress. The purpose of the spacer is to passively provide some measure of lift or elevation to the center of the mattress while leaving some space or a "gap" around the peripheral edges where it is now easier for the bed maker to slide their hands and the bed linens beneath the mattress edge without having to lift the mattress entirely.

In some embodiments, the spacer may be the same dimensions or slightly smaller than the mattress and may be shaped as a frustum, or truncated pyramid, with the wider base positioned on the support base and the smaller top surface adjacent the mattress bottom. This type of configuration provides a helpful gap along with a ramped surface to facilitate tucking of the bedding beneath the mattress.

As noted above, the spacer slightly elevates the center of the mattress relative to the underlying support. However, in use, the spacer is not necessarily noticed by anyone sleeping on top of the mattress. The person sleeping on the bedding generally sleeps in the middle portion of the mattress surface and would not notice the peripheral "gap" so to speak.

In some embodiments, multiple spacers can be combined together and layered to provide a variable and customized lift height.

In its various forms, the spacer could be made of foam, or other somewhat compressible material which would easily conform to the mattress and the underlying support structures yet provide enough support to elevate the mattress. Varying the density of the material can stiffen or soften the mattress above it. In some embodiments, an egg crate profile is provided to help airflow, reduce turning of the mattress and reduce potential bug issues.

In some embodiments, heating or cooling devices can be inserted into the spacer for additional comfort and functionality.

In various embodiments, the spacer can be a standalone piece which is positioned between a conventional box spring or platform and the mattress. This would allow the invention to be used with all existing mattress systems.

The spacer could also be formed as part of the mattress. For example, in a foam mattress, the spacer could be integrally formed on the bottom surface of the mattress during manufacturing. Likewise, for a conventional spring coil mattress, the spacer could be sewn into the bottom surface or Velcro attached as an option.

Additionally, in other embodiments, the spacer could be integrally formed as part of the bed platform, box spring, or foundation where the spacer would extend up from the upper surface of the platform or box spring. As well, the spacer could be provided as an optional feature and secured in place by various methods.

In all foam mattress configurations, the bedding system can be a single integrated support and mattress with a tucking gap formed all of the way around the peripheral edge.

Still further, the spacer could be sewn into separate mattress covers or cushions or pads, or bed bug sleeves, box spring valet covers, duvet covers, etc. Any configuration or accessory for the mattress, box spring, foundation platform, etc. could be made to include the novel spacer.

BRIEF DESCRIPTION OF THE DRAWING FIGURES

While the specification concludes with claims particularly pointing out and distinctly claiming particular embodiments of the present invention, various embodiments of the invention can be more readily understood and appreciated by one of ordinary skill in the art from the following descriptions of various embodiments of the invention when read in conjunction with the accompanying drawings in which:

DETAILED DESCRIPTION OF THE EXEMPLARY EMBODIMENTS

Figure 1:
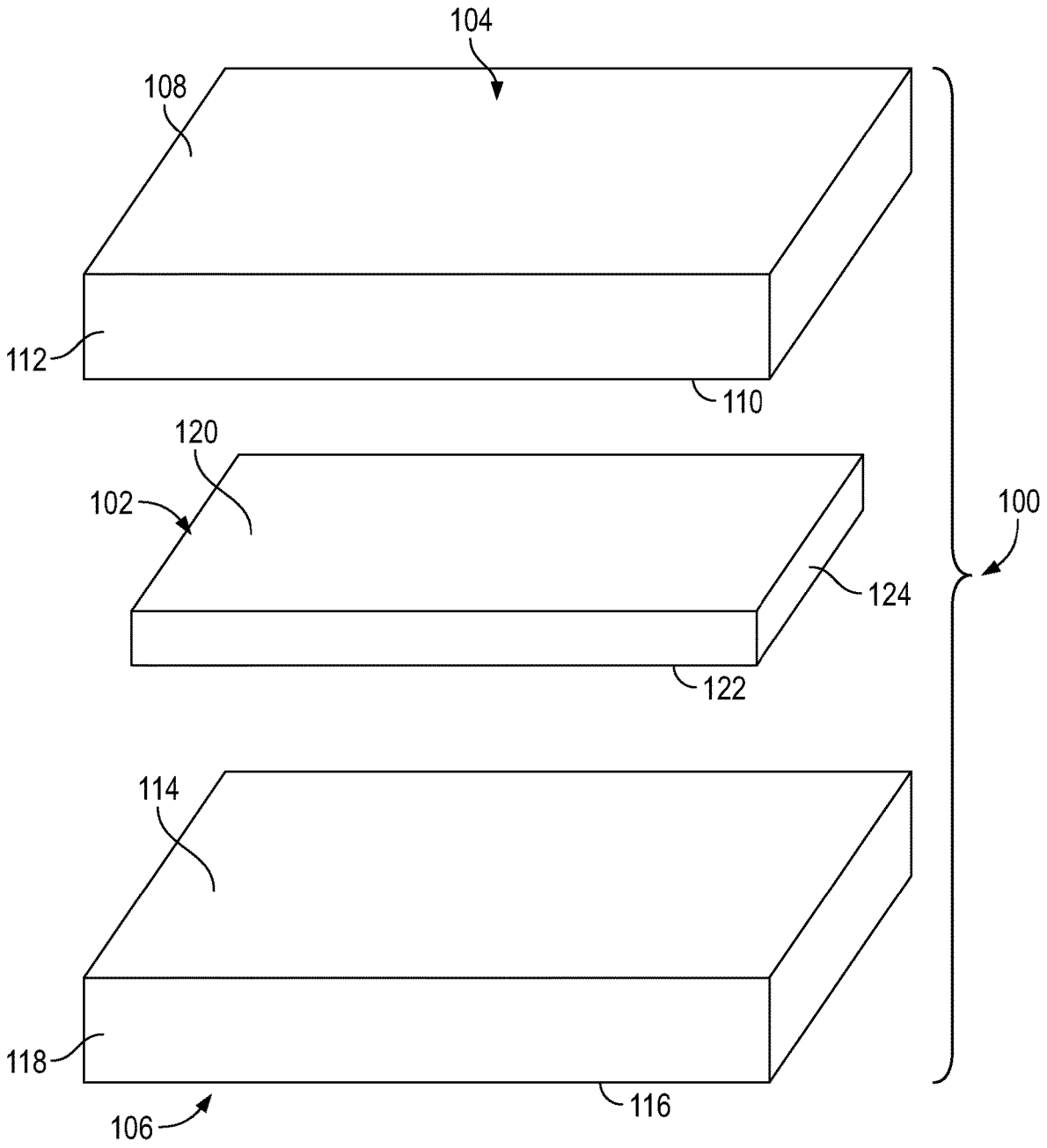
FIG. 1 is an exploded perspective sketch of one exemplary embodiment of the present mattress spacer and bedding system.
Figure 2:
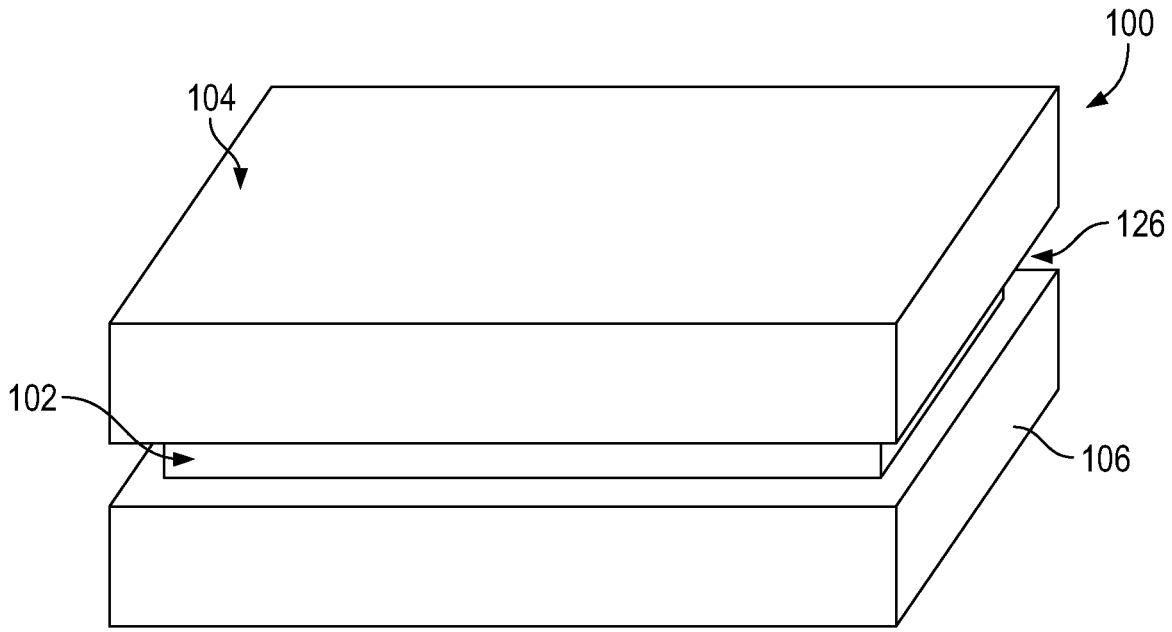
FIG. 2 is a perspective view thereof.
Figure 3:
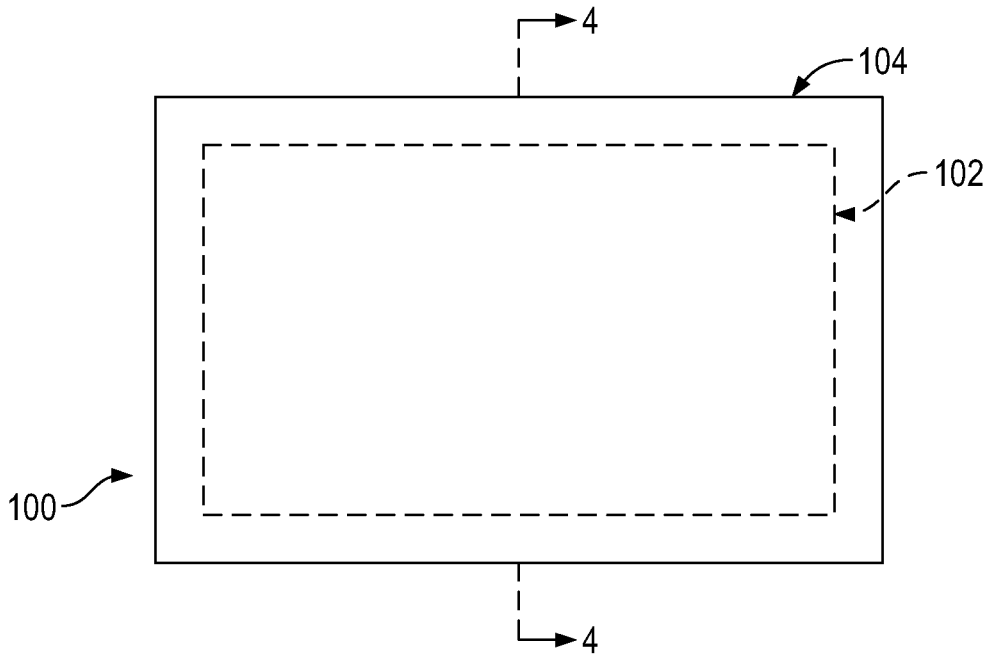
FIG. 3 is a top view thereof.
Figure 4:
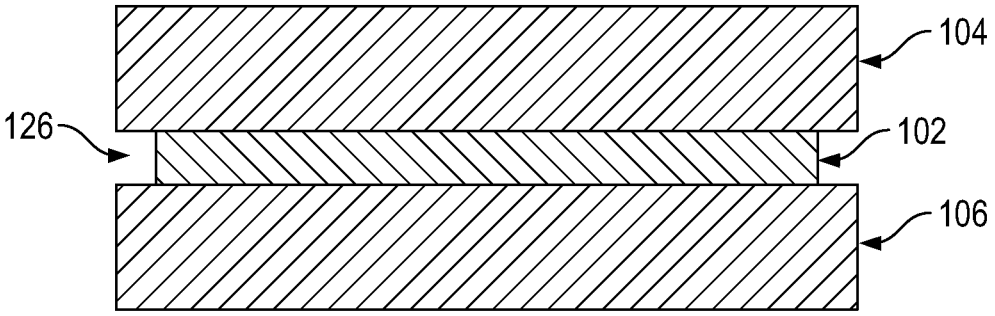
FIG. 4 is a cross-sectional view thereof.

Certain exemplary embodiments will now be described to provide an overall understanding of the principles of the structure, function, manufacture, and use of the device and methods disclosed herein. One or more examples of these embodiments are illustrated in the accompanying drawings. Those skilled in the art will understand that the devices and methods specifically described herein and illustrated in the accompanying drawings are non-limiting exemplary embodiments and that the scope of the present invention is defined solely by the claims. The features illustrated or described in connection with one exemplary embodiment may be combined with the features of other embodiments. Such modifications and variations are intended to be included within the scope of the present disclosure. Further, in the present disclosure, like-numbered components of the embodiments generally have similar features, and thus within a particular embodiment each feature of each like-numbered component is not necessarily fully elaborated upon. Additionally, to the extent that linear or circular dimensions are used in the description of the disclosed systems, devices, and methods, such dimensions are not intended to limit the types of shapes that can be used in conjunction with such systems, devices, and methods. A person skilled in the art will recognize that an equivalent to such linear and circular dimensions can easily be determined for any geometric shape. Further, to the extent that directional terms like top, bottom, up, or down are used, they are not intended to limit the systems, devices, and methods disclosed herein. A person skilled in the art will recognize that these terms are merely relative to the system and device being discussed and are not universal.

Generally, the present bedding system is designed to provide some measure of leverage for manipulating the mattress during the bed making process and eliminates the need for homemakers and hotel or motel housekeepers to physically lift any mattress during the bed making process. The present design enables a single person to do the job by herself/himself and without the need for an assistant and greatly reduces fatigue and physical strain.

Referring to FIGS. 1-4, a first exemplary embodiment of the mattress spacer and bedding configuration is illustrated and generally indicated at 100. The spacer and bedding system which can take on various forms depending on the bedding arrangement.

The system 100 comprises a passive "spacer" pad 102 or intermediate layer of material which is positioned between the bottom of a mattress 104 and the top of an underlying support 106, such as a box spring (as illustrated), or slats, or platform etc. The mattress 102 is conventional in the art and has an upper and lower surface 108, 110 and a peripheral side wall 112. The box spring 106 is also conventional, also having upper and lower surfaces 114, 116 and a peripheral side wall 118.

The exemplary spacer pad 102 has a top surface 120, a bottom surface 122, a side wall 124, and peripheral length and width dimensions that are roughly between about 1 and 18 inches smaller than the size of the mattress 104. This sizing pattern applies to all mattress configurations, including, but not limited to twin, double, queen, king, etc. More preferably, the spacer 102 is about 3-5 inches smaller than the mattress 104 on all sides. In use, the spacer pad 102 is positioned centrally beneath the mattress 104 to provide lift in the center and a small edge gap 126 between the mattress 104 and the support 106. The spacer pad 102 may have a thickness of between about ¼ inch and about 3 inches, but more preferably about 1 inch.

As noted above, the purpose of the spacer pad 102 is to provide some measure of elevation to the center of the mattress 104 while leaving some space or "gap" 126 around the peripheral edge where it is now easier for the bed maker to slide their hands and the bed linens beneath the mattress lower edge 110 without having to lift the mattress 104 at all.

In use, the spacer pad 102 slightly elevates the center of the mattress 104 relative to the underlying support 106 but is not necessarily noticed by anyone sleeping on the bed. The person sleeping on the bed generally sleeps in the middle portion of the mattress surface and will not notice the elevated middle or the peripheral "gap" 126 so to speak.

Table 1 below illustrates many advantages of the spacer pad bedding system 100.

TABLE 1

| Features | Mattress with "EasyTuck" Spacer | | Inflatable Bladder | | Arcuate Slats Platform | |
|---|---|---|---|---|---|---|
| Easy to setup for each bed making | Yes | Nothing to set up | No | Must inflate bladder | Yes | Nothing to set up |
| Keeps tucking gap fixed at optimal | Yes | Never changes from optimal gap | No | Difficult to set and maintain optimal gap | Yes | Cannot set to optimal gap |
| Maintains mattress' characteristics | Yes | No changes | No | Makes center of mattress sag. and makes mattress more bouncy | No | Raises center of mattress; and makes mattress more bouncy |
| Easy maintenance | Yes | Nothing to maintain | No | Must pump air periodically | No | Slats can break with heavy person, and can |

TABLE 1-continued

| Features | Mattress with "EasyTuck" Spacer | | Inflatable Bladder | | Arcuate Slats Platform | |
|---|---|---|---|---|---|---|
| | | | | | | break due to wood fatigue |
| Low cost | Yes | Comes with mattress | No | Must buy bladder and electric pump | No | Most buy it |
| Easy to install | Yes | Comes with mattress | No | Must pump exact amount of air, must find place to store pump | No | Slats must accurately positioned |
| Reliable | Yes | No moving parts | No | Bladder may leak, pump may break | No | Slats can break |
| Convenient to buy | Yes | Comes with mattress | No | Must find a vendor, buy it, and have it delivered | No | Most find a vendor, buy it, and have it delivered |

In its various forms, the spacer pad 102 could be made of foam, or other somewhat compressible material which would easily conform to the mattress 104 and/or to the underlying support structures 106 yet provide enough support to elevate the mattress 104. Varying the density of the pad material could provide added support or cushioning for the mattress above. Additionally, the spacer pad 102 could be provided with heating or cooling inserts (not shown) which would provide added comfort and functionality.

Figure 5:
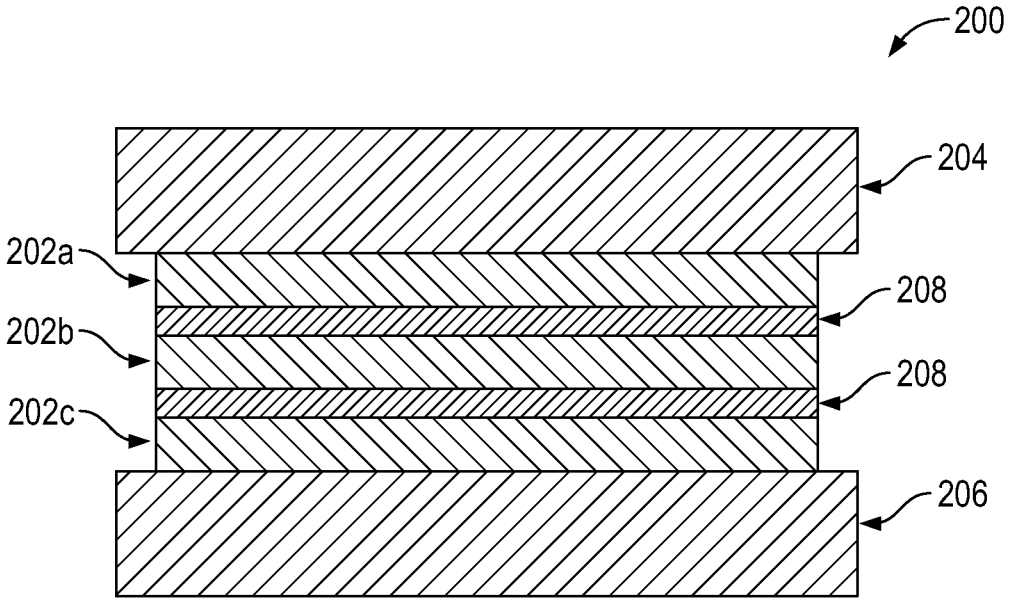
FIG. 5 is a cross-sectional view of another exemplary embodiment having multiple spacer pad layers.

Turning briefly to FIG. 5, another exemplary embodiment 200 of the bedding system is shown comprising a mattress 204, a support 206 a plurality of spacer pads 202*a*, 202*b*, 202*c* which are layered on top of each other to provide a variable or customized lift to the mattress 204. The spacer pads 202 can include hook and loop fasteners 208, and the like to maintain the spacer pads 202 in assembled relation and in position.

Figure 6:
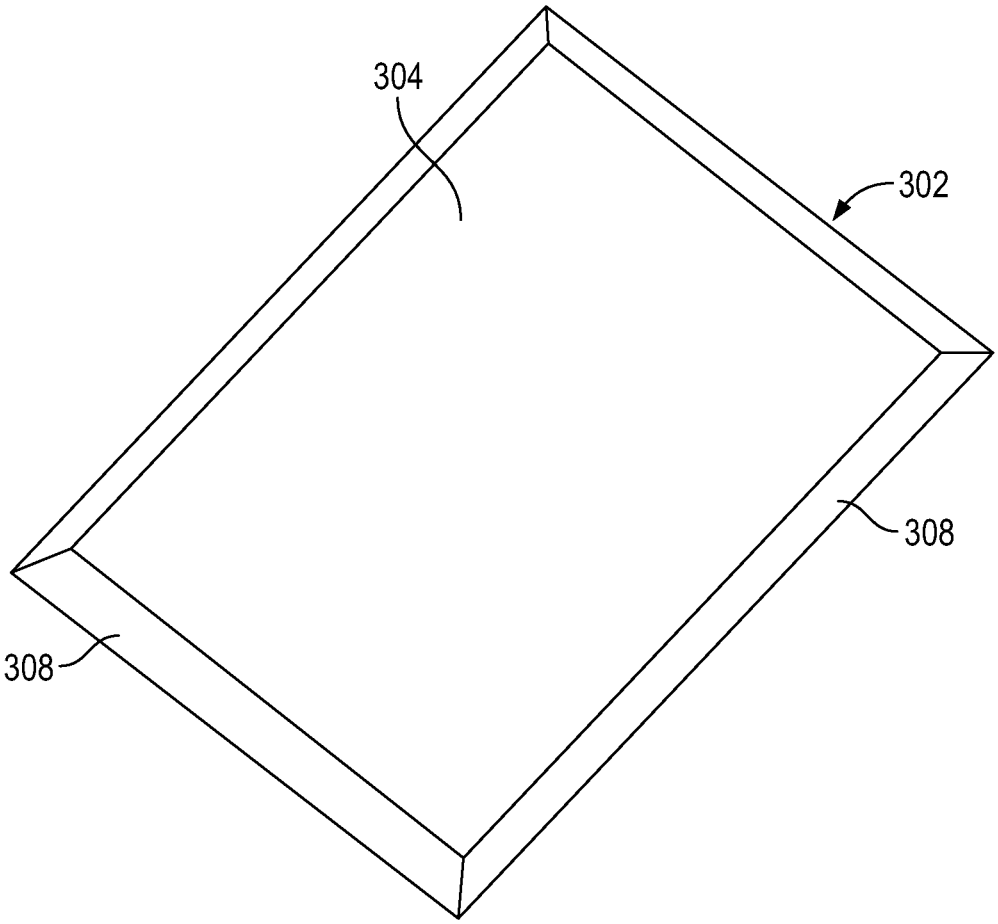
FIG. 6 is a perspective view of still another exemplary embodiment where the spacer is a frustum.
Figure 7:
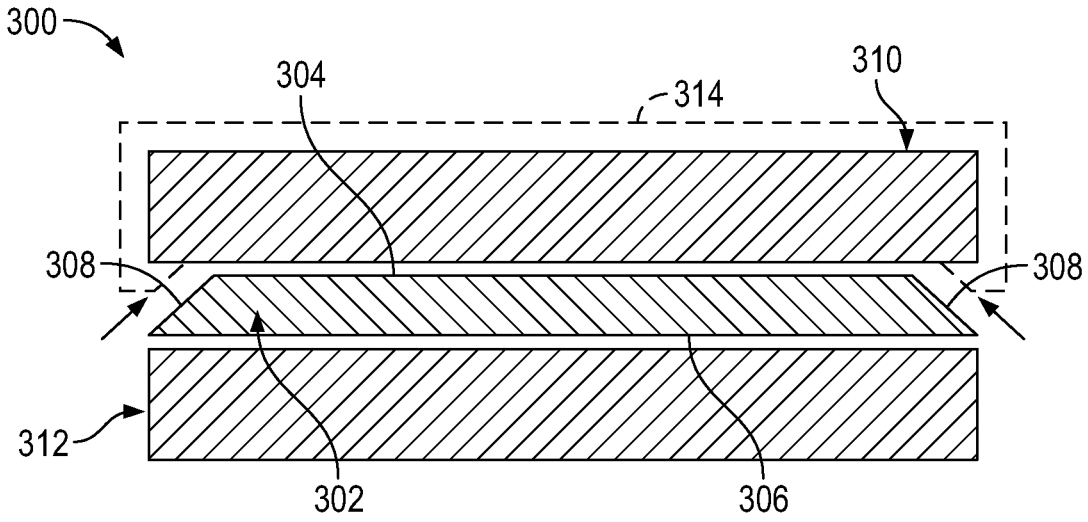
FIG. 7 is a cross-sectional view thereof.

Illustrated in FIGS. 6-7 is another exemplary embodiment 300, where the spacer pad 302 is formed in the shape of a frustum, i.e. a truncated pyramid shape, where the top surface 304 is slightly smaller than the bottom surface 306 around all of the edges, and the side wall 308 forms a ramped surface therebetween. In the preferred embodiment as illustrated, the bottom surface 306 has peripheral dimensions which are generally the same size as the mattress 310, while the top surface 304 is about 1-18 inches smaller (preferably about 3-5 inches) all around the periphery. When positioned beneath the mattress 310 and the support 312 as illustrated in FIG. 7, the spacer pad 302 elevates the mattress and provides a ramped wedge surface which most easily facilitates tucking of the bed linens (shown in broken line) 314 beneath the mattress 310 without lifting.

The spacer pad 102, 202, 302 as illustrated in the exemplary embodiments in FIGS. 1-7 may be a standalone piece (or pieces) which is/are positioned between a conventional box spring or platform and the mattress. This would allow the invention to be used with and retrofitted into all existing mattress systems. However, the spacer could also be formed as part of the support or the mattress.

Figure 8:
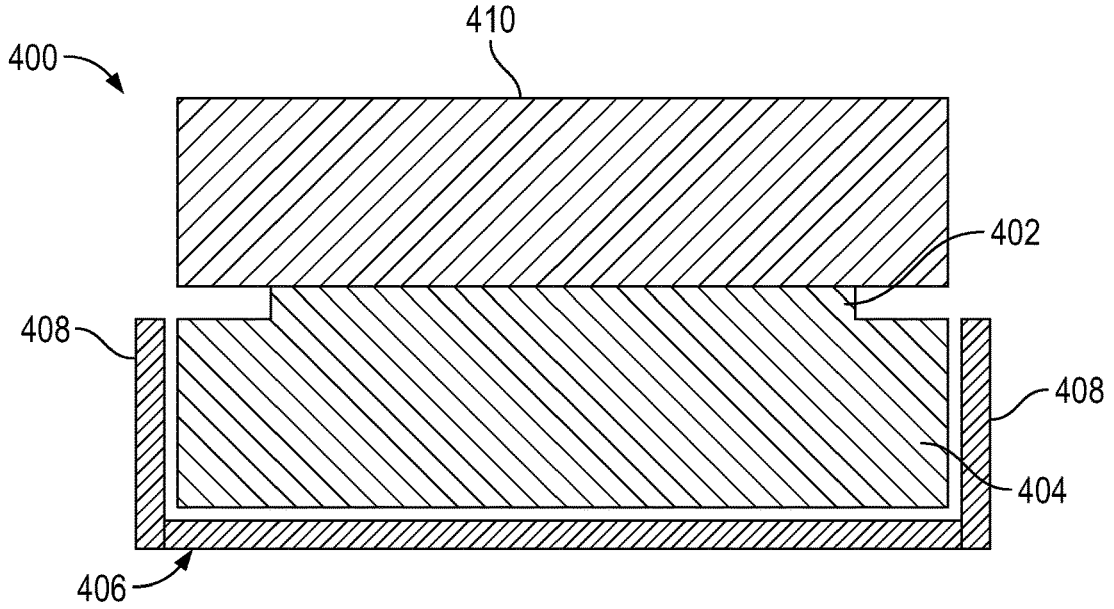
FIG. 8 is a cross-sectional view of another exemplary embodiment where the pad is integrally formed with the box spring or support.
Figure 9:
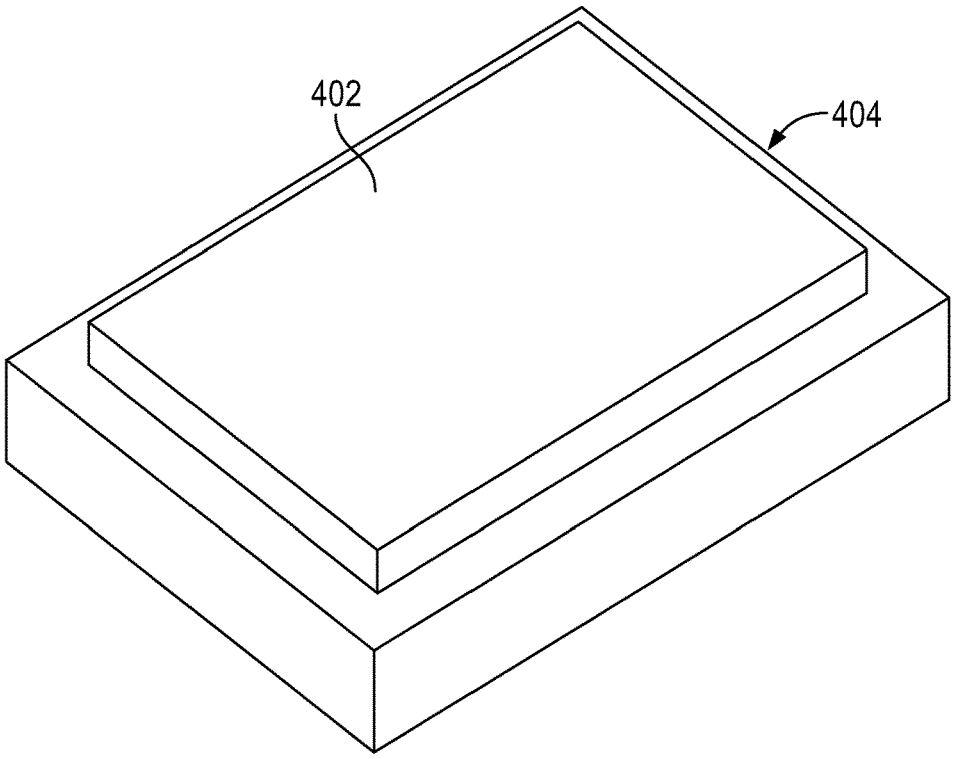
FIG. 9 is a perspective view of the exemplary support thereof.

Referring to FIGS. 8 and 9, there is illustrated another exemplary embodiment 400 where the spacer structure 402 (shoulder/pad) is formed on directly onto the top surface of a box spring 404 or other platform. This configuration can be used for any mattress platform such as a bed frame platform, or other planar foundation. In this regard, the spacer or spacer pad 402 would extend up from the upper surface of the platform or box spring 404. This configuration also provides an advantage when used with bed frames 406 that include side rails 408. As seen in FIG. 8, the spacer structure 402 elevates the mattress 410 above the upper edge of the rails 408 and alleviates the issue of having to lift the mattress 410 above the rail edge to tuck the bed linens. The shape of the spacer shoulder or pad 402 could be a conventional rectangular shape as in the first exemplary embodiments, or may be provided with ramped frustum edges (not shown), as described above.

Figure 10:
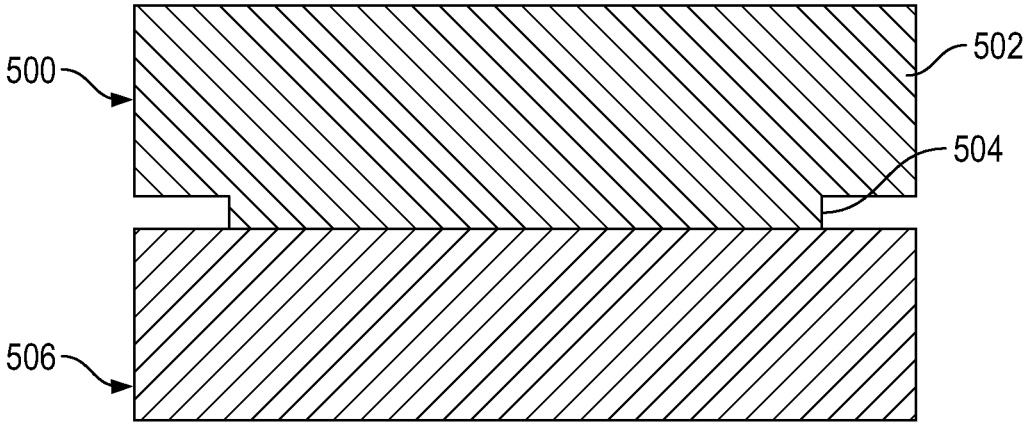
FIG. 10 is a cross-sectional view of an exemplary embodiment with the spacer to the bottom of the mattress.

Turning now to FIG. 10, another exemplary embodiment is illustrated in the form of a foam or conventional mattress 500 having a main body portion 502 and a spacer shoulder or pad 504 integrally formed on the bottom surface of the mattress body 502 during manufacturing. When positioned on a support 506 the mattress is elevated. For a foam mattress, the shoulder spacer could be simply cut out of the foam material. Likewise, for a conventional spring coil mattress, the spacer could be sewn into the bottom surface or Velcro attached as an option.

Figure 11:
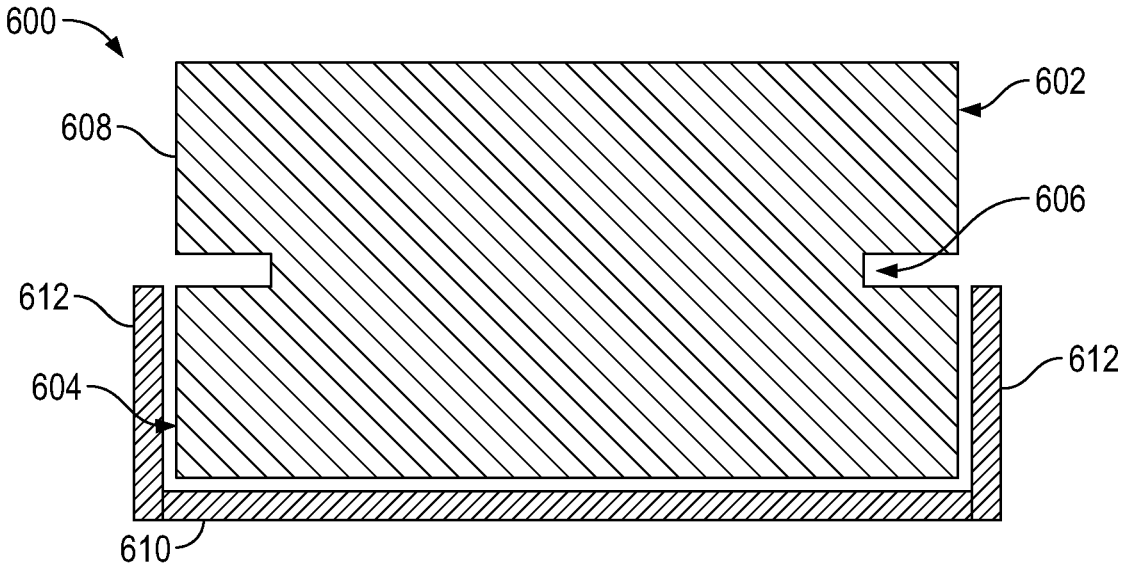
FIG. 11 is a cross-sectional view of a further embodiment where the support and mattress are integrally formed and provided with a peripheral gap to facilitate tucking of the bed linens.
Figure 12:
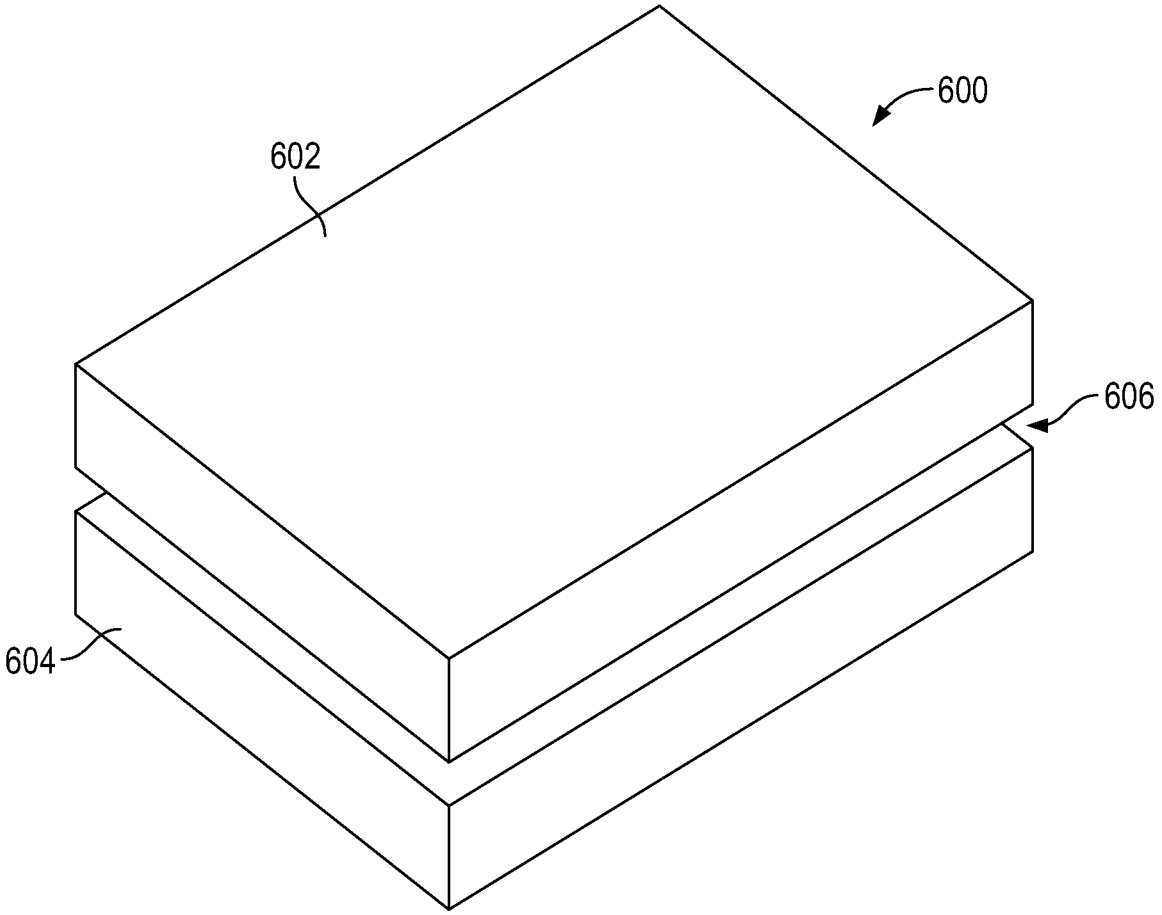
FIG. 12 is a perspective view thereof.

Now turning to FIGS. 11-12, there is illustrated another embodiment, where the bedding system 600 is formed as an integral piece. In the illustrated embodiment, the mattress 600, which could be either a foam mattress or other conventional mattress, including an upper portion 602 and a lower portion 604 is integrally formed with the peripheral edge gap 606 around the sidewall 608. The peripheral tucking gap 606 can be formed at any vertical location along the sidewall 608. In the illustrated embodiment, the mattress 600 is formed having a double-thicknesses to eliminate the bottom box spring or platform. Upper portion 602 has the thickness of a mattress, and the lower portion 604 has the thickness of a box spring. The peripheral edge gap 606 is advantageously located mid-way in the height and places the gap at an optimal height. When used with a bed frame 610 with rails 612, the gap 608 can be placed at an optimal height. In other embodiments, the mattress body 600 can be formed with a conventional mattress thickness and the gap 606 can be located nearer to the bottom surface to provide an optimal tucking location.

Figure 13:
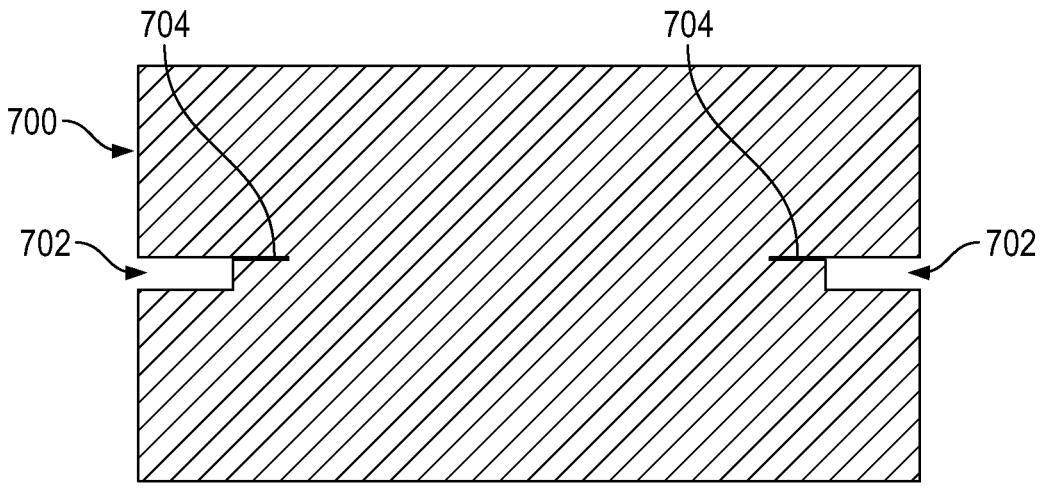
FIG. 13 is an even further embodiment where the gap includes an additional slot extending inwardly from the gap.
Figure 14:
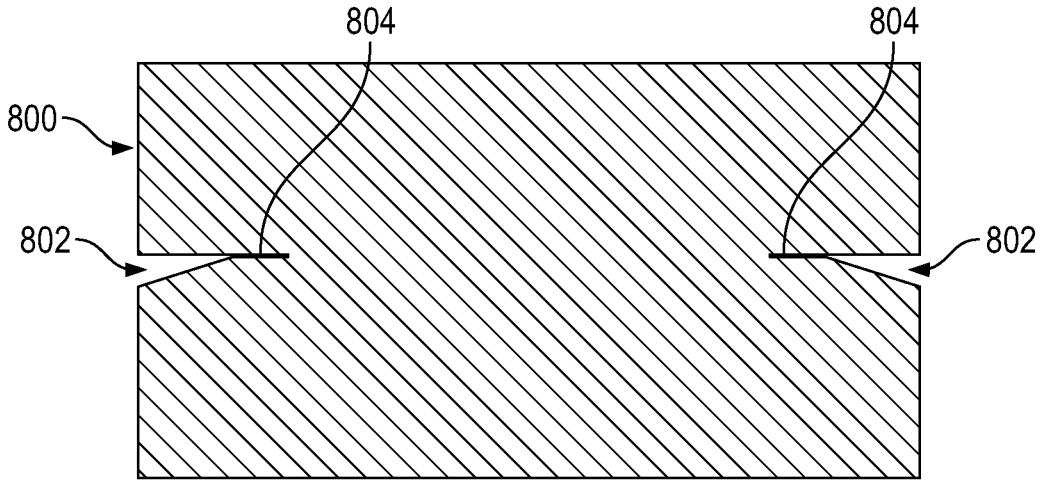
FIG. 14 is yet a further embodiment where the gap is angled and includes a tucking slot extending inwardly from the inner apex of the angled gap.

Illustrated in FIGS. 13 and 14 are still further embodiments 700 and 800, where the mattresses, such as described above, are provided with an additional slot extending further inwardly from the peripheral gap. The slot may provide an additional space to tuck the bed linens into a tighter gap for better holding.

FIG. 13 illustrates an embodiment 700 with a square or rectangular gap 702 and slot 704 extending further inwardly therefrom.

FIG. 14 illustrates an embodiment 800 with an angled or ramped gap (frustum) 802 and slot 804.

Preferably, the slots 7024, 804 extend inwardly from the upper edges of the gaps 702, 802 but may be located elsewhere as desired.

Still further, it is contemplated that the novel spacer pad and system as described hereinabove, could be sewn into separate mattress covers or cushions or pads, or bed bug sleeves, box spring valet covers, duvet covers, etc. Any existing or future configuration or accessory for a mattress, box spring, foundation platform, etc. could be made to include the novel spacer system to facilitate tucking of the bed linens.

Having thus described certain particular embodiments of the invention, it is understood that the invention that may be defined by any appended claims is not to be limited by particular details set forth in the above description, as many apparent variations thereof are contemplated. Rather, the invention is limited only be the appended claims, which include within their scope all equivalent devices or methods which operate according to the principles of the invention as described.

What is claimed is:

1. A bedding system comprising:

a mattress having a lower surface with a peripheral outer edge;

a mattress support; and a frustum-shaped spacer pad positioned between the mattress and the mattress support, wherein the spacer pad has a bottom surface and a top surface, and angled side walls extending therebetween, wherein said bottom surface of said spacer pad has a peripheral outer edge with peripheral edge dimensions which are substantially the same as peripheral edge dimensions of the peripheral outer edge of said lower surface of said mattress and whereby said lower surface of said mattress entirely overlies said spacer pad, wherein said top surface of said spacer pad has a peripheral outer edge, wherein peripheral edge dimensions of said peripheral outer edge of the top surface of said spacer pad are less than said peripheral edge dimensions of the peripheral outer edge of said lower surface of said mattress, whereby said angled side walls form a ramped surface and cooperate with said lower surface of said mattress to create an angled gap into which bed linens may be guided and tucked with a user's fingers without lifting the mattress, and wherein said spacer pad is passive and said angled gap is fixed relative to the mattress both when the mattress is in use and when the mattress is not in use, and wherein said spacer pad is made of foam or other compressible solid material.

2. The bedding system of claim 1 wherein the spacer pad has a thickness of between about ¼ inch and about 3 inches.

3. The bedding system of claim 1 wherein the peripheral outer edge dimensions of the top surface of the spacer pad are between about 1 inch and about 18 inches smaller than the peripheral outer edge of the bottom surface of the mattress.

4. The bedding system of claim 3 wherein the spacer pad has a thickness of between about ¼ inch and about 3 inches.

5. The bedding system of claim 4 further comprising a spacer pad cover, and wherein said spacer pad is disposed inside said spacer pad cover.

6. The bedding system of claim 1 further comprising a spacer pad cover, and wherein said spacer pad is disposed inside said spacer pad cover.

7. The bedding system of claim 1, wherein said spacer pad has no moving parts.

8. A bedding system comprising:

a mattress having a lower surface with a peripheral outer edge;

a mattress support; and a frustum-shaped spacer pad positioned between the mattress and the mattress support, wherein the spacer pad has a bottom surface and a top surface, and angled side walls extending therebetween, wherein said bottom surface of said spacer pad has a peripheral outer edge with peripheral edge dimensions which are substantially the same as peripheral edge dimensions of the peripheral outer edge of said lower surface of said mattress and whereby said lower surface of said mattress entirely overlies said spacer pad, wherein said top surface of said spacer pad has a peripheral outer edge, wherein peripheral edge dimensions of said peripheral outer edge of the top surface of said spacer pad are less than said peripheral edge dimensions of the peripheral outer edge of said lower surface of said mattress, whereby said angled side walls form a ramped surface and cooperate with said lower surface of said mattress to create an angled gap into which bed linens may be guided and tucked with a user's fingers without lifting the mattress, wherein said angled gap is fixed relative to the mattress when the spacer is in a predetermined position relative to the mattress, and wherein said spacer pad has no moving parts and is passive in operation, and wherein said spacer pad is made of foam or other compressible solid material.

9. The bedding system of claim 8 wherein the spacer pad has a thickness of between about ¼ inch and about 3 inches.

10. The bedding system of claim 8 further comprising a spacer pad cover, and wherein said spacer pad is disposed inside said spacer pad cover.

11. The bedding system of claim 9 further comprising a spacer pad cover, and wherein said spacer pad is disposed inside said spacer pad cover.

* * * * *